United States Patent [19]

Larsson et al.

[11] 4,267,866

[45] May 19, 1981

[54] METHOD AND MACHINE FOR FILLING A CAPSULE WITH POWDER

[75] Inventors: Hans-Gunnar Larsson; Erik Westman, both of Vesteras, Sweden

[73] Assignee: ASEA Aktiebolag, Vesteras, Sweden

[21] Appl. No.: 71,485

[22] Filed: Aug. 31, 1979

[30] Foreign Application Priority Data

Sep. 6, 1978 [SE] Sweden ..... 7809365

[51] Int. Cl.[3] ..... B65B 1/14

[52] U.S. Cl. ..... 141/1; 141/34; 141/83

[58] Field of Search ..... 141/1-12, 141/34, 83, 250-284, 163, 167

[56] References Cited

U.S. PATENT DOCUMENTS 1,761,228 6/1930 Peck ..... 141/34

2,502,087 3/1950 Goldberg ..... 141/34

*Primary Examiner*—Houston S. Bell, Jr.

*Attorney, Agent, or Firm*—Watson, Cole, Grindle & Watson

[57] ABSTRACT

The invention relates to a method for filling a capsule under rotation and a machine for carrying out the method. The capsule is rotated at a variable speed during the filling so that the centrifugal force at the inner surface of powder present in the capsule is essentially equal to the gravity. The centrifugal machine comprises a holder for the capsule and a drive structure by which the holder is driven at variable speed. The amount of supplied powder is measured and the speed is controlled in dependence on the output signal generated by the measurement.

6 Claims, 2 Drawing Figures

METHOD AND MACHINE FOR FILLING A CAPSULE WITH POWDER

BACKGROUND

1. Field of the Invention

The present invention relates to a method of filling a capsule having a preferably ring-shaped or disc-shaped cavity with powder which, by a subsequent isostatic pressing, is transformed into a solid body with a high density. The invention also contemplates a centrifugal filling machine for the capsule for carrying out the method.

2. Prior Art

Rings or discs for turbines, especially for gas turbines, comprise alloys with a high percentage of additives of alloying materials, so-called superalloys, which provide a material with good strength properties at high temperatures. Such superalloys are difficult to machine, both during casting and during the subsequent forging and machining operations. When manufacturing blanks an uneven composition is obtained through segregation of alloying materials during solidification. The subsequent forging operation has to be carried out within a temperature interval often requiring close tolerances. This forging may be rendered difficult by material segregation. The surface layers may absorb gases which deteriorate the properties of the material. This may necessitate considerable working allowance, i.e. a great deal of material has to be removed by expensive machining. In addition, the material in itself is expensive which means that a great deal of material has to be scrapped during machining, and this contributes to increase the cost of production of the turbine discs.

For the above reasons, production of turbine discs has recently evolved, in which the starting material is a powder which is filled into capsules having substantially the same shape as the turbine discs when finished, and which is bonded together by hot isostatic pressing to form a dense homogeneous body. The dimensions of the capsule must be determined with regard to the degree of filling, shrinkage and distortion, dependent on the degree of filling during the hot pressing. The degree of filling is dependent on the distribution of the grain size in the powder and the distortion is dependent on how even the density is in the powder of the filled capsule. A suitable distribution of grain sizes from the point of view of filling, with fine fractions which fill up the gaps between coarse fraction in a satisfactory manner, may provide a very good degree of filling under favorable filling conditions; however, under unfavorable filling conditions, a separation of coarse and fine grain fractions may be obtained. This separation results in a deteriorated degree of filling and increased shrinkage and distortion, for example skewness, because the density is different in different parts of the powder in a capsule.

Heretofore, rotary-symmetrical capsules made into, for example, turbine discs, have either been filled from the periphery in a stationary capsule, or from the center in a rapidly rotating capsule. During the fall down to the capsule bottom, or to powder already located there, an unfavorable separation has occurred. When filling a rotating capsule, the capsule rotates so rapidly that the powder is thrown with great force outwards towards the periphery. However, it is also known that when filling during rotation a considerable and harmful separation of coarse and fine powder grains may be obtained. Contrary to expectation, the powder is not deposited evenly in the capsule. On the contrary, there is obtained an uneven structure of powder so that a wave shape is obtained with respect to a circle concentric with the capsule center. From inwardly-directed wave crests coarser powder grains roll down into the wave trough, where a concentration of coarse grains is obtained, thus obtaining an uneven density. This results in uneven shrinkage and distortion, which necessitates an undesirable excessive measure of the capsule.

SUMMARY OF THE INVENTION

According to the invention, it is possible to prevent the above-mentioned harmful wave formation which gives rise to separation of different powder fractions. According to the invention, a capsule is rotated in a centrifugal machine around a horizontal axis at a speed which varies during the filling in such a manner that the centrifugal force at the inner surface of powder present in the capsule is substantially equal to, or somewhat greater than, gravity. However, it may be suitable to rotate the capsule at a higher speed at the beginning and end of the filling. The speed of rotation of the capsule is suitably regulated in dependence on the amount of supplied powder since a direct determination of the powder surface inside a sheet-metal capsule is not feasible. The determination of the supplied powder quantity may be made by weighing the powder receptacle which is supported by a pair of scales, the number of revolutions being determined by the weight of the remaining powder in the receptacle. A measurement signal emanating from the scales is input to control equipment for a drive motor.

Another possibility is to locate a measuring device between the powder receptacle and the capsule, which device measures the amount of powder passing through. An outgoing measuring signal influences the drive equipment of the motor and determines the speed in dependence on the amount of powder passing through. If the capsule is filled at atmospheric pressure, the gas is sucked from the capsule and the capsule is sealed gas-tightly before being removed from the centrifugal machine. If the capsule is filled in vacuum, the capsule need only be sealed. The atmospheric pressure compresses the capsule so that it maintains its shape during subsequent handling, thus preventing movement of the powder. To improve the packing of the powder during filling, the capsule can be subjected to vibrations with a frequency of between 1 and 5 Hertz continuously or intermittently during filling. The new manner of filling a capsule results in such an even density and good repeatability that disc billets can be manufactured with less working allowance than with prior art processes.

The invention also relates to a machine for centrifugal filling of capsules according to the method described. This centrifugal machine includes a rotatable disc having fastening means for the capsule and drive means for rotating the disc at a variable speed. Since the speed is dependent on the inner surface of the powder layer, i.e. on the amount of powder introduced into the capsule, the speed must be dependent on the amount of powder introduced. The speed is determined by measuring means which, in one way or another, continuously or periodically measures the amount of supplied powder. Such measuring means may consist of a pair of scales which either measure the powder that has been fed in, or the powder that remains in, a powder receptacle. The speed is determined in dependence on the registered weight. The scales may, for example, support a powder receptacle which, before each filling of a capsule, is supplied with an amount of powder adapted to the capsule. The scales may be connected to a current supply unit for a DC motor and an output signal from the scales may determine the speed of this motor. The relationship between the scale signal and the speed is, of course, dependent on the design of the capsule.

BRIEF DESCRIPTION OF THE FIGURES

The invention will be described in greater detail with reference to the accompanying Figures.

DETAILED DESCRIPTION

Figure 1:
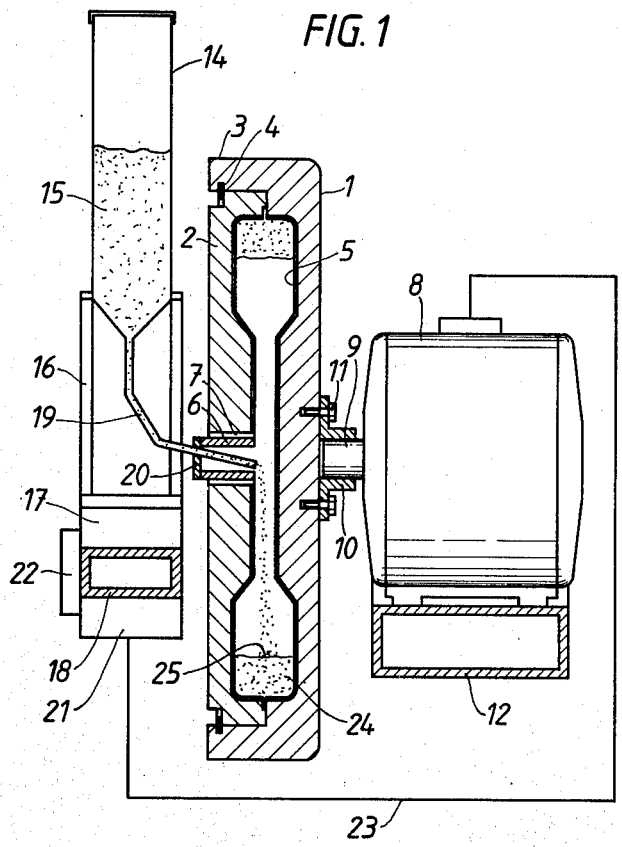
FIG. 1 shows schematically the design of a capsule centrifugal machine.

In the Figures, 1 designates a rotatable disc with a disc-shaped fastening means 2, which is fixed radially with respect to disc 1 by flange 3, and which is fixed axially by locking ring 4 in a groove in flange 3. Disc 1 and fastening device 2 form a forming cavity adapted to sheet-metal capsule 5 such that the walls of the capsule are supported during the filling, and deformation or bursting of the capsule is prevented. Capsule 5 is provided at the center with sleeve 6 which passes through opening 7 in fastening device 2. Disc 1 is fixed to shaft end 9 of motor 8 by sleeve 10 provided with a flange. The flange of sleeve 10 is joined to disc 1 by bolts 11. Motor 8 is supported by beam 12. Beam 12 can be movably suspended in such a manner that it rotates around a horizontal axis, thus permitting it to rotate 90° at the end of a working cycle together with discs 1 and 2. At the end of the filling, capsule 5 then rotates around a vertical axis. Sleeve 6 of capsule 5 is also sealed with the capsule in a horizontal position. If capsule 5 is filled at atmospheric pressure, the gas in the capsule is sucked off prior to this sealing. The air pressure causes a compression of the powder in the capsule so that the capsule with the powder becomes stable and manageable.

Figure 2:
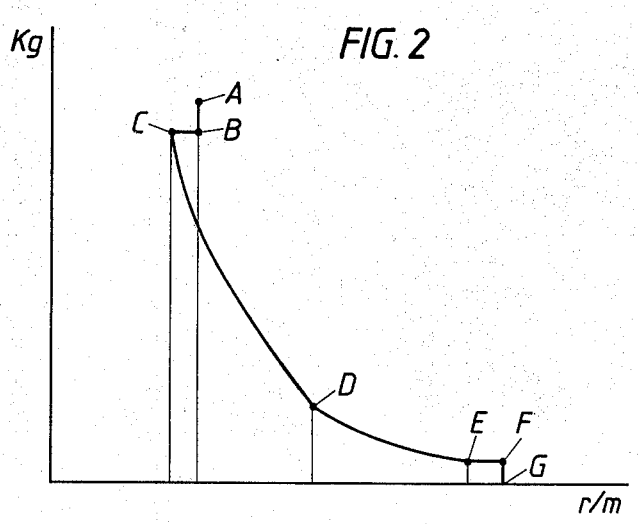
FIG. 2 shows the relationship between the amount of supplied powder and the speed of the machine.

Powder container 14 storing powder 15 is supported by stand 16 and rests on scale 17 on beam 18. Powder container 14 is provided with filling tube 19 which projects into sleeve 6. Between tube 19 and sleeve 6 is seal 20. Scale 17 is connected by cable 22 to current supply unit 21. Motor 8 and current supply unit 21 are interconnected by cable 23. Current supply unit 21 is programmed so that the speed of motor 8 is varied with respect to the amount of powder 24 in rotating capsule 5 in a predetermined manner. For example, the relationship between the amount of powder 15 in container 14 and the motor speed may be as shown in FIG. 2. The vertical axis shows the amount of powder 15 in container 14, and the horizontal axis shows the speed of motor 8. When the filling of powder starts, capsule 5 is operated with a speed of such a magnitude that the centrifugal force due to the rotation exceeds the force of gravity. The distance A-B in the diagram represents that period of the filling operation. When a powder layer has been formed along the periphery of capsule 5, the speed is reduced so that the centrifugal force at inner surface 25 of the powder ring in capsule 5 is only equal to, or somewhat exceeds, gravity. This reduction of speed is represented by distance B-C in the diagram. For the major part of the filling operation, the speed is changed successively so that the centrifugal force at surface 25 corresponds to, or somewhat exceeds, gravity. This part of the filling is represented by distance C-E in the diagram. Towards the end of the filling, the speed is increased so that the centrifugal force at the powder surface exceeds gravity. This increase in speed is represented by distance E-F in the diagram. The final filling, which can take place with capsule 5 in a horizontal position, may be carried out at a constant speed. This final filling is represented by the distance F-G in the diagram. The diagram presupposes a continuous change of the speed. The sharp change of the inclination of the curve at D is obtained at the transition between the thicker and the thinner portion of capsule 5 when the reduction of the diameter is greatly increased when a certain quantity of powder is supplied, and the speed thus has to be increased more rapidly.

What is claimed is:

1. A method of filling a capsule having a ring or disc-shaped cavity, comprising the steps of:

rotating the capsule around a horizontally positioned shaft;

feeding powder into the central portion of the cavity within the capsule; and controlling the speed of rotation of the capsule such that the centrifugal force at the inner surface of powder within the capsule cavity is substantially equal to the force of gravity.

2. Method according to claim 1, wherein the step of controlling the speed of rotation of the capsule is performed in dependence on the amount of powder supplied to the capsule.

3. Method according to claim 2, further comprising the step of weighing the powder contained in a supply container and the step of controlling the capsule speed of rotation is dependent on the weight of the powder in said supply container.

4. Method according to claim 2, further comprising the step of measuring the amount of powder passing from a powder container to the capsule cavity and said step of controlling the speed of capsule rotation is carried out in dependence on the measured amount of powder fed to the capsule cavity.

5. Apparatus for rotating a capsule to be filled with powder, comprising:

a rotatable member including means for fastening the capsule;

drive means for rotating said member at a variable speed;

means for supplying powder to said capsule;

means for measuring the amount of powder supplied to said capsule; and means for controlling said drive means to regulate the speed of rotation of said member in dependence on the powder supplied to said capsule.

6. Apparatus as in claim 5, wherein said means for supplying powder includes a powder container; and further comprising a scale for weighing said powder and generating a signal representative thereof, said means for controlling being responsive to said signal.

* * * * *